United States Patent [19]

Sakaguchi et al.

[11] Patent Number: 4,536,467

[45] Date of Patent: Aug. 20, 1985

[54] HEAT DEVELOPMENT OF SILVER HALIDE ELEMENT WITH REDOX DYE RELEASER AND STABILIZER

[75] Inventors: Yukihiko Sakaguchi; Toshiaki Aono; Shinsaku Fujita, all of Kanagawa, Japan

[73] Assignee: Fuji Photo Film Co., Ltd., Kanagawa, Japan

[21] Appl. No.: 594,632

[22] Filed: Mar. 29, 1984

[30] Foreign Application Priority Data

Mar. 30, 1983 [JP] Japan ..... 58-54164

[51] Int. Cl.[3] ..... G03C 5/54; G03C 1/40; G03C 1/34

[52] U.S. Cl. ..... 430/203; 430/216; 430/219; 430/351; 430/372; 430/559; 430/607; 430/617; 430/619

[58] Field of Search ..... 430/203, 223, 216, 218, 430/372, 551, 351, 617, 619, 607, 219, 559

[56] References Cited

U.S. PATENT DOCUMENTS

| | | | |
|---|---|---|---|
| 4,193,802 | 3/1980 | Mukunoki et al. | 430/607 |
| 4,228,235 | 10/1980 | Okonogi et al. | 430/372 |
| 4,308,328 | 12/1981 | Salyer et al. | 430/372 |
| 4,430,415 | 2/1984 | Aono et al. | 430/353 |
| 4,463,079 | 7/1984 | Naito et al. | 430/203 |
| 4,473,631 | 9/1984 | Hirai et al. | 430/351 |
| 4,500,626 | 2/1985 | Naito et al. | 430/559 |

*Primary Examiner*—Richard L. Schilling
*Attorney, Agent, or Firm*—Sughrue, Mion, Zinn, Macpeak & Seas

[57] ABSTRACT

A process for forming an image is described, comprising heating a light-sensitive material in a substantially water-free condition to form a mobile dye in an image pattern, said material having a support bearing thereon light-sensitive silver halide, a binder, and a dye-releasing redox compound capable of imagewise reducing the silver halide and releasing a hydrophilic dye on reaction with said silver halide when heated, after or simultaneously with imagewise exposure, in the presence of a compound having a melting point below 60° C. represented by formula (A)

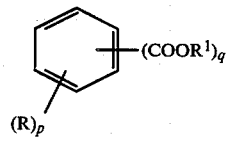

(A)

wherein p is an integer of 1 to 5 and q is an integer of 1 to 4, provided that p+q is 6 or less; R represents a hydrogen atom, an alkyl group, a cycloalkyl group, an alkenyl group, an aryl group, an alkoxy group, an aryloxy group, an aralkyl group, an acyl group, an acylamino group, an alkylsulfonylamino group, an alkoxyalkyl group, an aryloxyalkyl group, an acyloxy group, an acyloxyalkyl group, a carbamoyl group, an N-substituted carbamoyl group, a ureido group, an N-substituted ureido group, an alkylamino group, a dialkylamino group, an arylamino group, a halogen atom, a hydroxy group, a carboxy group, a nitro group, a cyano group, an alkyoxycarbonyl group, an aryloxycarbonyl group, or a cycloalkyloxycarbonyl group; and $R^1$ represents an alkyl group, an alkenyl group, a cycloalkyl group, an alkenyl group, a cycloalkyl group or an aryl group. Also, a heat developable light-sensitive material is disclosed.

36 Claims, No Drawings

HEAT DEVELOPEMENT OF SILVER HALIDE ELEMENT WITH REDOX DYE RELEASER AND STABILIZER

FIELD OF THE INVENTION

The present invention relates to a novel process for forming a dye image by heating a light-sensitive material in a substantially water-free condition.

Furthermore, the present invention relates to a novel light-sensitive material containing a dye releasing redox compound which releases a hydrophilic dye upon reaction with a light-sensitive silver halide by heating in a substantially water-free condition.

More particularly, the present invention relates to a novel process for forming a dye image by transferring a dye released by heating into a dye fixing layer.

BACKGROUND OF THE INVENTION

Photographic processes utilizing silver halide have heretofore been widely used due to excellent photographic characteristics, such as sensitivity, control of gradation, etc., as compared with other photographic processes, such as an electrophotographic process or a diazo photographic process. In recent years, a silver halide material-based technique capable of easily and quickly obtaining an image has been developed by changing the conventional wet development process using, for example, a developing solution, into a dry development process, such as a process using heat for development.

Heat-developable light-sensitive materials are known where this technique is used. Such heat-developable light-sensitive materials and processes therefor are described, for example, in *Shashin Kogaku no Kiso,* Corona Co., Ltd., pages 553–555, *Eizo Joho,* April 1978, page 40, *Nebletts Handbook of Photography and Reprography,* 4th Ed., Van Nostrand Reinhold Co., pages 32–33, U.S. Pat. Nos. 3,152,904, 3,301,678, 3,392,020 and 3,457,075, British Pat. Nos. 1,131,108 and 1,167,777, and *Research Disclosure,* June 1978, pages 9–15 (RD-17029).

Many processes for obtaining color images using a dry process have been proposed.

With respect to processes for forming color images by the reaction of an oxidation product of a developing agent with a coupler, use of a p-phenylenediamine type reducing agent and a phenolic coupler or an active methylene coupler as described in U.S. Pat. No. 3,531,286, a p-aminophenol type reducing agent as described in U.S. Pat. No. 3,761,270, a sulfonamidophenol type reducing agent as described in Belgian Pat. No. 802,519 and *Research Disclosure,* pages 31 and 32 (September, 1975) and the combination of a sulfonamidophenol type reducing agent and a 4-equivalent coupler as described in U.S. Pat. No. 4,021,240, have been proposed.

These processes, however, are disadvantageous in that turbid color images are formed, because a reduced silver image and a color image are simultaneously formed in the exposed area after heat-development. In order to eliminate these disadvantages, a process which comprises removing the silver image by liquid processing or a process which comprises transferring only the dye to another layer, for example, a sheet having an image receiving layer has been proposed. However, the latter process is not desirable from the viewpoint that it is not easy to separate the dye from unreacted substances and transfer the dye only.

Another process, which comprises introducing a nitrogen-containing heterocyclic group into a dye, forming a silver salt, and releasing a dye by heat-development has been described in *Research Disclosure,* No. 16966, pages 54 to 58 (May, 1978). Clear images cannot be obtained using this process, because it is difficult to control the release of dyes from the unexposed areas, and thus it is not a generally applicable process.

Also, processes for forming a positive-working color image using a silver dye bleach process utilizing heat, with useful dyes and methods for bleaching have been described, for example, in *Research Disclosure,* No. 14433, pages 30 to 32 (April, 1976), ibid., No. 15227, pages 14 and 15 (December, 1976) and U.S. Pat. No. 4,235,957.

However, this process requires an additional step and an additional material for accelerating the bleaching of the dyes, for example, heating with a superposed sheet with an activating agent. Furthermore, this process is not desirable from the viewpoint that the resulting color images are gradually reduced and bleached by free silver which is present during long periods of storage.

Moreover, a process for forming a color image utilizing a leuco dye is described, for example, in U.S. Pat. Nos. 3,985,565 and 4,022,617. However, this process is not desirable because it is difficult to incorporate the leuco dye in the photographic material in a stable manner and coloration gradually occurs during storage.

Another disadvantage is that generally the above-described processes require quite a long time for development and result in images with high fog and low density.

SUMMARY OF THE INVENTION

The present invention is intended to overcome the above-described problems of the known light-sensitive materials, and provides a novel process for forming dye images by heating a light-sensitive material in a substantially water-free condition.

An object of the invention is to provide a novel process for forming an image in which a mobile hydrophilic dye released on heating in a substantially water-free condition is transferred into a dye-fixing layer to obtain a dye image.

Another object of the invention is to provide a process for improving stability with time.

The expression "stability with time" is used herein to mean the stability of a light-sensitive material during its storage prior to heat development. That is, improving the stability with time is to prevent the formation of fog and a change in maximum density of light-sensitive materials during their storage prior to heat development.

Still another object of the invention is to provide a process for forming sharp dye images in a simplified manner.

Yet another object of the invention is to provide a heat developable silver halide light-sensitive material obviating the disadvantages of the conventional heat developable silver halide light sensitive materials.

These and other objects of the present invention can be attained by providing a process for forming an image, comprising heating a light-sensitive material in a substantially water-free condition to form a mobile dye in an image pattern, said material having:

a support bearing thereon light-sensitive silver halide;

a binder; and a dye-releasing redox compound capable of imagewise reducing the silver halide and releasing a hydrophilic dye on reaction with said silver halide when heated, after or simultaneously with imagewise exposure, in the presence of a compound having a melting point below 60° C. represented by formula (A)

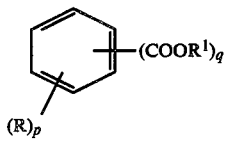

(A)

wherein p is an integer of 1 to 5 and q is an integer of 1 to 4, provided that p+q is 6 or less; R represents a hydrogen atom, an alkyl group, a cycloalkyl group, an alkenyl group, an aryl group, an alkoxy group, an aryloxy group, an aralkyl group, an acyl group, an acylamino group, an alkylsulfonylamino group, an arylsulfonylamino group, an alkoxyalkyl group, an aryloxyalkyl group, an acyloxy group, an acyloxyalkyl group, a carbamoyl group, an N-substituted carbamoyl group, a ureido group, an N-substituted ureido group, an alkylamino group, a dialkylamino group, an arylamino group, a halogen atom, a hydroxy group, a carboxy group, a nitro group, a cyano group, an alkoxycarbonyl group, an aryloxycarbonyl group or a cycloalkyloxycarbonyl group; and $R^1$ represents an alkyl group, an alkenyl group, a cycloalkyl group or an aryl group.

Further, the present invention provides a heat developable color photographic material comprising:

a support bearing thereon light-sensitive silver halide;

a binder;

a dye-releasing redox compound capable of reducing the silver halide and releasing a hydrophilic dye on reaction with the silver halide when heated; and a compound having a melting point below 60° C. represented by formula (A)

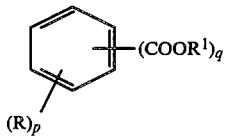

(A)

wherein p, q, R and $R^1$ have the same meanings as defined above.

DETAILED DESCRIPTION OF THE INVENTION

The alkyl, cycloalkyl and aryl groups represented by R or the alkyl, cycloalkyl and aryl moieties of the groups represented by R may be substituted with a halogen atom, a hydroxy group, an alkoxy group, a cyano group, an aryloxy group, an alkyl group, an alkoxycarbonyl group or an aryloxycarbonyl group. When p is 2 or more, the R's may be the same or different.

The alkyl, cycloalkyl and aryl groups represented by $R^1$ may be substituted with a halogen atom, a hydroxy group, an alkoxy group, a cyano group, an aryloxy group, an alkyl group or an alkoxycarbonyl group. When q is 2 or more, the $R^1$'s may be the same or different.

When R represents a group containing one or more carbon atoms, the total number of the carbon atom(s) of the group inclusive of the substituent(s), if any, is preferably from 1 to 40, and more preferably from 1 to 20 carbon atoms.

Preferred examples of R include alkyl groups (for example, a methyl group, an ethyl group, a butyl group, an isoheptyl group, an octyl group, a tetradecyl group, etc.), alkoxy groups (for example, a methoxy group, an ethoxy group, a butoxy group, etc.), halogen atoms (for example, chlorine, bromine, fluorine, etc.), and a hydrogen atom. Of these, a hydrogen atom is particularly preferred.

It is preferred for the alkyl, alkenyl, cycloalkyl or aryl group represented by $R^1$ to have 60 or less carbon atoms inclusive of the substituent(s) thereof, if any.

In formula (A), $R^1$ is preferably an alkyl group having from 1 to 40, and more preferably from 1 to 20 carbon atoms, a cycloalkylalkyl group having from 6 to 46, and more preferably from 6 to 26 carbon atoms, an alkenyl group having from 2 to 40, and more preferably 2 to 20 carbon atoms, an alkoxyalkyl group having from 3 to 60, and more preferably from 3 to 40 carbon atoms, or an alkoxycarbonylalkyl group having from 3 to 60, and more preferably from 3 to 40 carbon atoms.

Preferred examples of the alkyl group represented by $R^1$ include a methyl group, an ethyl group, a propyl group, an isopropyl group, a butyl group, an isobutyl group, a pentyl group, a hexyl group, a 2-ethylbutyl group, an isoheptyl group, an octyl group, a 2-ethylhexyl group, an isodecyl group, a dodecyl group, an isododecyl group, a tetradecyl group, a hexadecyl group, an isooctadecyl group, etc.

Preferred examples of the cycloalkylalkyl group represented by $R^1$ include a cyclohexylmethyl group, a cycloheptylmethyl group, a cyclododecylmethyl group, etc.

Preferred examples of the alkenyl group represented by $R^1$ include an allkyl group ($-CH_2CH=CH_2$), a methallyl group, a 9-decene-1-yl group, an oleyl group, etc.

Preferred examples of the alkoxyalkyl group represented by $R^1$ include a 2-methoxyethyl group, 2-ethoxyethyl group, a 2-propoxyethyl group, a 2-isopropoxyethyl group, a 2-butoxyethyl group, a 2-hexyloxyethyl group, a 1-butoxy-2-propyl group, a 2-dodecyloxyethyl group, etc.

Preferred examples of the alkoxycarbonylalkyl group represented by $R^1$ include an ethoxycarbonylmethyl group, a 1-butoxycarbonylethyl group, a 1-ethoxycarbonylethyl group, etc.

The alkyl, alkenyl, alkoxyalkyl and alkoxycarbonylalkyl groups are particularly preferred for $R^1$. Of these, the alkyl group is most preferred.

Preferred values of p and q in the general formula (A) are such that p is 4 and q is 2, or p is 5 and q is 1.

The compound which can be used in the present invention represented by formula (A) has a melting point below 60° C., and preferably −196° C. or more.

Suitable examples of the compound represented by formula (A) include the following:

| | | Melting Point |
|---|---|---|
| (1) | 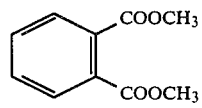 | 0° C. |

-continued

| | | Melting Point |
|---|---|---|
| (2) | 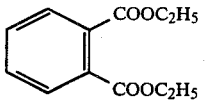 | −40° C. |
| (3) | 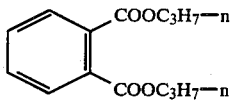 | Liquid at room temperature |
| (4) | 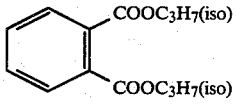 | Liquid at room temperature |
| (5) | 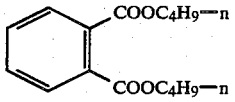 | −35° C. |
| (6) | 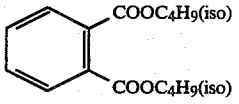 | −50° C. |
| (7) | 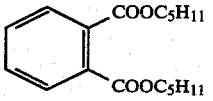 | −75° C. or less |
| (8) | 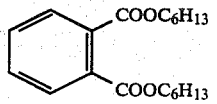 | −46° C. |
| (9) | 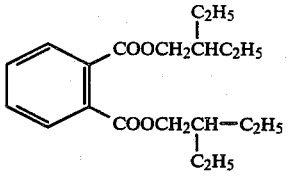 | −50° C. |
| (10) | 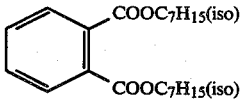 | Liquid at room temperature |
| (11) | 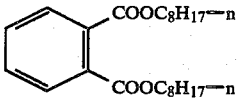 | −40° C. |
| (12) | 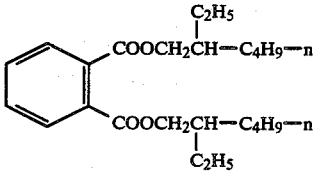 | −55° C. or less |
| (13) | 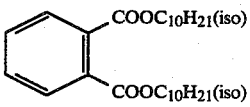 | −37° C. |
| (14) | 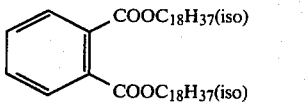 | Liquid at room temperature |
| (15) | 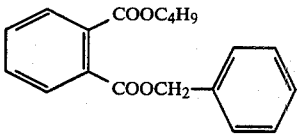 | −40° C. |
| (16) | 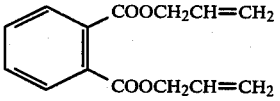 | Liquid at room temperature |
| (17) | 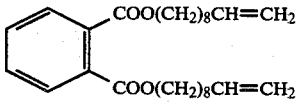 | Liquid at room temperature |
| (18) | 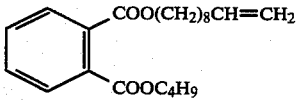 | Liquid at room temperature |
| (19) | 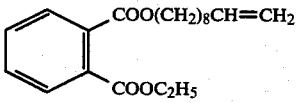 | Liquid at room temperature |
| (20) | 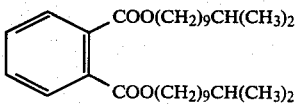 | Liquid at room temperature |
| (21) | 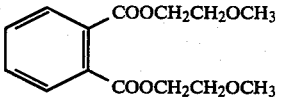 | −40° C. |
| (22) | 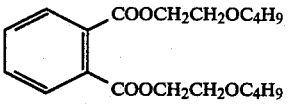 | −50° C. |
| (23) | 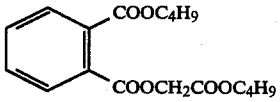 | −35° C. or less |
| (24) | 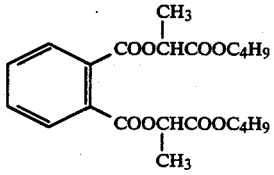 | Liquid at room temperature |
| (25) | 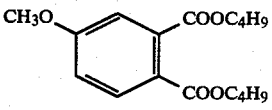 | Liquid at room temperature |

-continued

| | | Melting Point |
|---|---|---|
| (26) | 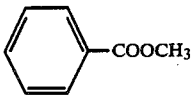 | Liquid at room temperature |
| (27) | 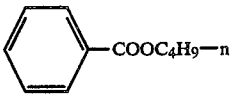 | −22° C. |
| (28) | 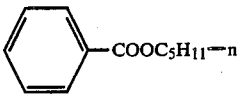 | Liquid at room temperature |
| (29) | 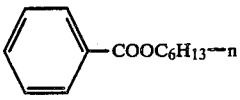 | Liquid at room temperature |
| (30) | 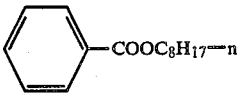 | Liquid at room temperature |
| (31) | 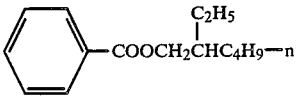 | Liquid at room temperature |
| (32) | 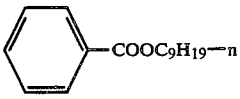 | Liquid at room temperature |
| (33) | 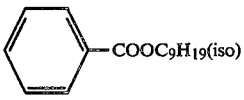 | Liquid at room temperature |
| (34) | 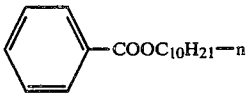 | Liquid at room temperature |
| (35) | 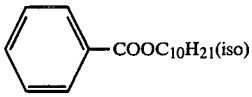 | Liquid at room temperature |
| (36) | 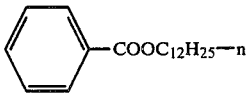 | Liquid at room temperature |
| (37) | 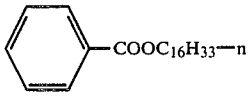 | Liquid at room temperature |
| (38) | 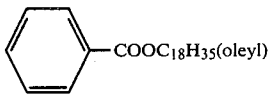 | Liquid at room temperature |

-continued

| | | Melting Point |
|---|---|---|
| (39) | 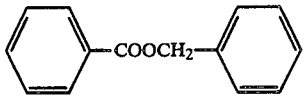 | Liquid at 60° C. |
| (40) | 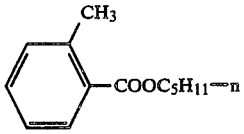 | Liquid at 60° C. |
| (41) | 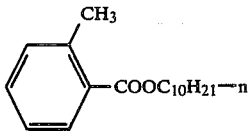 | Liquid at 60° C. |
| (42) | 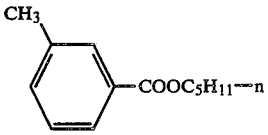 | Liquid at 60° C. |
| (43) | 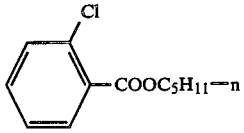 | Liquid at 60° C. |
| (44) | 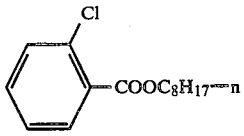 | Liquid at 60° C. |
| (45) | 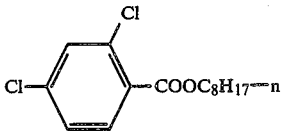 | Liquid at 60° C. |
| (46) | 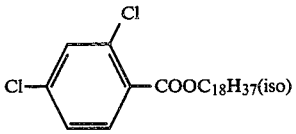 | Liquid at 60° C. |
| (47) | 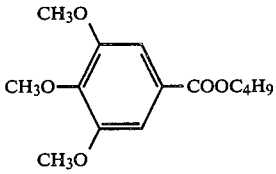 | Liquid at 60° C. |
| (48) | 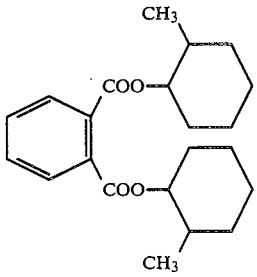 | Liquid at 60° C. |

-continued

| | | Melting Point |
|---|---|---|
| (49) | 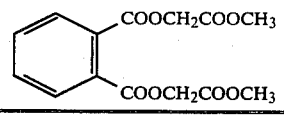 | Liquid at 60° C. |

Generally, compounds represented by formula (A) can be prepared by esterifying a carboxylic acid or a carboxylic anhydride or reacting a carboxylic acid chloride with an alcohol. These synthesis processes can be carried out according to the teachings in, for example, *Rodd's Chemistry of Carbon Compounds,* 2nd Ed. Vol III-E, pages 40–42, *Tanryotai Goseiho,* Kyoritsu Shuppan Co., Ltd. (1967), pages 234–239, S. R. Sandler and W. Karo: *Organic Functional Group Preparation,* Academic Press (1968) Vol. I, pages 245–268, etc.

Synthesis of the compounds represented by formula (A) will be explained in greater detail with reference to the following synthesis example in which synthesis of Compound (16) (diallyl phthalate) is described.

SYNTHESIS EXAMPLE

A mixture of 14.8 g of phthalic anhydride, 12.8 g of allyl alcohol and 8 ml of benzene was admixed with 0.1 ml of sulfuric acid and the mixture was heated under reflux. Refluxing was continued for 5 hours while removing water which formed as an azeotropic mixture. The reaction mixture was cooled and washed with water and then with a 5% potassium carbonate aqueous solution. The organic layer was dried over anhydrous sodium sulfate and distilled under reduced pressure. The product (yield 20 g) has a boiling point of 150°–159° C./4 mm Hg and was liquid at room temperature.

Compounds (1) to (57) can be prepared in an analogous manner as the above process. However, some of compounds (1) to (57) are also available commercially, and commercial products can be used in the present invention. For example, the following commercial products can be used.

| Compound No. | Commercial Product | Manufacturer |
|---|---|---|
| 5 | DBP | Kyowa Hakko Kogyo Co., Ltd. |
| | Vinisizer #40 | Kao Soap Co., Ltd. |
| 12 | DOP | Kyowa Hakko Kogyo Co., Ltd. |
| | Vinisizer #60 | Kao Soap Co., Ltd. |
| 11 | Vinisizer #80 | Kao Soap Co., Ltd. |
| 2 | DEP | Kyowa Hakko Kogyo Co., Ltd. |
| 13 | DIDP | Kyowa Hakko Kogyo Co. Ltd. |
| 4 | DIBP | Sekisui Chemical Co., Ltd. |

Further, diamyl phthalate (Compound (7)), dihexyl phthalate (Compound (8)), butyl octyl phthalate, butyl isodecyl phthalate, butyl lauryl phthalate, di(2-ethylhexyl)phthalate (Compound (12)), di-n-octyl phthalate (Compound (11)), di-2-octyl phthalate, dilauryl phthalate, diheptyl phthalate, di-isotyl phthalate, octyl decyl phthalate, n-octyl n-decyl phthalate, di-tridecyl phthalate, ethylhexyl decyl phthalate, dinonyl phthalate, butyl benzyl phthalate (Compound (15)), etc., are also commercially available (e.g., see *Binran Gomu Purasuchikku Haigo Yakuhin* (Manual of Rubbers and Plastics Compounding Agents) edited by Rubber Digest Co., Ltd. (1966), pages 116–126).

The compounds of formula (A) can be used singly or in combination with each other, and can be dispersed in an aqueous solution of hydrophilic colloid by the aid of dispersing agents. This method of dispersion is described, for example, in U.S. Pat. Nos. 2,304,939, 2,322,027, 2,801,170, 2,801,171, and 2,949,360.

The compounds of formula (A) can be used in combination with high boiling organic solvents such as phosphoric acid esters (e.g., diphenyl phosphate, triphenyl phosphate, tricresyl phosphate and dioctyl butyl phosphate), citric acid esters (e.g., tributyl acetylcitrate), benzoic acid esters (e.g., octyl benzoate), alkylamides (e.g., diethyllaurylamide), and fatty acid esters (e.g., dibutoxyethyl succinate and dioctyl acetate).

Usually the compounds of formula (A) can be dispersed in an aqueous solution of hydrophilic colloid in combination with dye-releasing redox compounds and low boiling organic solvents having a boiling point ranging between about 30° and 160° C. with the aid of dispersing agents. If desired, other photographic additives can be dispersed at the same time.

Low boiling organic solvents having a boiling point ranging between about 30° and 160° C. which can be used in the present invention include lower alkyl acetates such as ethyl acetate and butyl acetate, ethyl propionate, sec-butyl alcohol, methyl isobutyl ketone, β-ethoxyethyl acetate, methyl cellosolve, and cyclohexanone.

Examples of the dispersing agents usually employed include anionic surfactants (e.g., sodium alkylbenzenesulfonate, sodium dioctylsulfosuccinate, sodium dodecylsulfate, sodium alkylnaphthalenesulfonate, and Fischer type couplers), amphoteric surfactants (e.g., N-tetradecyl-N,N-dipolyethylene-α-betaine), and nonionic surfactants (e.g., sorbitan monolaurate). In addition, the surfactants described in other parts of the present specification can be used as dispersing agents.

A dispersion composed of compounds of formula (A) containing dye-releasing redox compounds can be added to an emulsion layer, such as a silver halide emulsion layer, and/or an intermediate layer of a heat-developable light-sensitive material. On the other hand, a dispersion composed of compounds of formula (A) which does not contain dye-releasing redox compounds can be incorporated in a hdyrophilic colloid layer (e.g., a surface protective layer and an intermediate layer) and en emulsion layer (e.g., a silver halide emulsion layer) of a heat-developable light-sensitive material, or a mordant-containing layer of a fixing material as described hereinafter, or other suitable layers. Incorporation of the compounds of the present invention in such layers of the light-sensitive material can be performed by known techniques such as the method described in U.S. Pat. No. 2,322,027.

The compounds of formula (A) of the present invention are usually added in an amount of from 0.01 to 20 times (by weight), and preferably from 0.01 to 5 times (by weight) as much as the amount of dye-releasing redox compounds.

In cases wherein the compounds of formula (A) are not used in a dispersion containing a dye-releasing redox compound, it is preferred for the compounds of the general formula (A) to be used in an amount of from 0.001 to 5 g/m$^2$.

The term "dye image" as used herein includes both multicolor and monocolor dye images. Monocolor dye images include a monocolor image obtained by mixing two or more dyes.

According to the image formation process of the present invention, a silver image and a mobile dye image corresponding to the silver image can be formed simultaneously by merely heating the material simultaneously with or after imagewise exposure. In other words, in image formation according to the present invention, when the heat-developable light-sensitive material is imagewise exposed and developed by heating in a substantially water-free condition, a redox reaction occurs between the light-sensitive silver halide and the dye releasing redox compound due to the action of the exposed light-sensitive silver halide as a catalyst, thereby forming a silver image in the exposed area. At this stage, the dye releasing redox compound is oxidized by the silver halide into the corresponding oxidation product. As a result, a hydrophilic mobile dye is released, and the silver image and mobile dye are formed in the exposed area. The presence of a dye releasing aid at this stage accelerates the above-described reaction. By transferring the thus formed mobile dye into, for example, a dye fixing layer, the desired dye image can be obtained.

The above explanation has been made as to the use of negative-working emulsion. In the case of an autopositive-working emulsion, the same principles are generally applicable, with the exception that the silver image and mobile dye are formed in the unexposed areas.

The redox reaction between the light-sensitive silver halide and a dye releasing redox compound and the subsequent dye releasing reaction according to the present invention involve reactions which occur at high temperatures and also in a substantially water-free dry condition. The term "high temperature" as used herein means temperatures of about 80° C. or more. The term "substantially water-free condition" means a condition which is in an equilibrium state with respect to the moisture in air but there is no supply of water from the outside of the system. Such a condition is described in T. H. James, *The Theory of the Photographic Process*, 4th Ed., 1977, Macmillan at page 374. Sufficient reactivity has been confirmed to be attained even in a substantially water-free condition from the fact that the reactivity of a test sample does not decrease even if it is vacuum dried at $10^{-3}$ mmHg for one day.

The dye releasing reaction has conventionally been believed to take place by the attack of a nucleophilic reagent and is usually carried out in a liquid having a pH of 10 or more. Therefore, it has been unexpected that high reactivity can be attained at high temperatures in a substantially water-free condition.

The above-described reactions proceed smoothly, particularly in the presence of an organic silver salt oxidizing agent, such as silver benzotriazole, to produce a high image density. It is, therefore, particularly preferable in the present invention that such an organic silver salt oxidizing agent be present in the system.

The dye releasing redox compound which releases a hydrophilic diffusible dye which can be used in the present invention is a compound as described in European Patent Application (OPI) No. 76,492, which disclosure is herein incorporated by reference. The dye releasing compound is represented by formula (I):

$$R_a—SO_2—D \quad (I)$$

wherein $R_a$ represents a reducing group capable of being oxidized by silver halide and D represents an image forming dye moiety containing a hydrophilic group.

The above-described compound is oxidized corresponding to or in a reverse manner corresponding to the latent image distributed imagewise in the silver halide, and a mobile dye is released in an imagewise manner.

Detailed definitions of $R_a$ and D, examples of the specific compounds and synthesis examples thereof are described in European Patent Application (OPI) No. 76,492.

Suitable dye releasing redox compounds which also can be used in the present invention include such compounds as described, for example, in U.S. Pat. No. 4,055,428, Japanese Patent Application (OPI) Nos. 12642/81, 16130/81, 16131/81, 650/82 and 4043/82, U.S. Pat. Nos. 3,928,312 and 4,076,529, U.S. Published patent application No. B 351,673, U.S. Pat. Nos. 4,135,929 and 4,198,235, Japanese Patent Applicaton (OPI) No. 46730/78, U.S. Pat. Nos. 4,273,855, 4,149,892, 4,142,891 and 4,258,120, etc., the disclosures of which are incorporated herein by reference. These compounds are also effective in addition to the above-described compounds.

Further, the dye releasing redox compounds which release a yellow dye as described, for example, in U.S. Pat. Nos. 4,013,633, 4,156,609, 4,148,641, 4,165,987, 4,148,643, 4,183,755, 4,246,414, 4,268,625 and 4,245,023, Japanese Patent Application (OPI) Nos. 71072/81, 25737/81, 138744/80, 134849/80, 106727/77, 114930/76, etc., the disclosures of which are incorporated herein by reference, can be effectively used in the present invention.

Dye releasing redox compounds which release a magenta dye, as described, for example, in U.S. Pat. Nos. 3,954,476, 3,932,380, 3,931,144, 3,932,381, 4,268,624 and 4,255,509, Japanese Patent Application (OPI) Nos. 73057/81, 71060/81, 134850/80, 40402/80, 36804/80, 23628/78, 106727/77, 33142/80 and 53329/80, etc., the disclosures of which are herein incorporated by reference, can also be effectively used in the present invention.

Similarly, dye releasing redox compounds which release a cyan dye, as described, for example, in U.S. Pat. Nos. 3,929,760, 4,013,635, 3,942,987, 4,273,708, 4,148,642, 4,183,754, 4,147,544, 4,165,238, 4,246,414 and 4,268,625, Japanese Patent Application (OPI) Nos. 71061/81, 47823/78, 8827/77 and 143323/78, etc., the disclosures of which are herein incorporated by reference, can be effectively used in the present invention.

Two or more dye releasing redox compounds can be used together, if desired. In these cases, the two or more dye releasing redox compounds may be used together in order to achieve a particular hue or in order to achieve a black color.

The dye releasing redox compounds are suitably used in a range from about 10 mg/m$^2$ to about 15 g/m$^2$, and preferably in a range from 20 mg/m$^2$ to 10 g/m$^2$, in total.

In the present invention, if desired, a reducing agent may also be used. The reducing agent in this case is a so-called auxiliary developing agent, which is oxidized by the silver halide and/or the organic silver salt oxidizing agent to form an oxidized product having the ability to oxidize the reducing group $R_a$ in the dye releasing redox compound of formula (I).

Examples of useful auxiliary developing agents include the compounds specifically described in European Patent Application (OPI) No. 76,492.

Suitable reducing agents which can be used in the present invention include the following compounds: hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)-catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Various combinations of developing agents as described in U.S. Pat. No. 3,039,869 can also be used.

In the present invention, the amount of the reducing agent which can be employed is from 0.01 mol to 20 mols per mol of silver and more preferably from 0.1 mol to 10 mols per mol of silver.

The silver halide used in the present invention can be silver chloride, silver chlorobromide, silver chloroiodide, silver bromide, silver iodobromide, silver chloroiodobromide and silver iodide, etc.

In the embodiment of the present invention in which the organic silver salt oxidizing agent is not used together with the silver halide, but rather the silver halide is used alone, a particularly preferred silver halide is silver halide partially containing a silver iodide crystal in the particles. That is, a silver halide in which the X-ray diffraction pattern shows the presence of pure silver iodide is particularly preferred.

In photographic materials a silver halide containing two or more kinds of halogen atoms can be used. Such a silver halide yields a completely mixed crystal in a conventional silver halide emulsion. For example, the particles of silver iodobromide show an X-ray diffraction pattern at a position corresponding to the mixed ratio of silver iodide crystal and silver bromide crystal but not at a position corresponding to pure silver iodide crystal and pure silver bromide crystal separately.

Particularly preferred examples of silver halides which can be used in the present invention include silver chloroiodide, silver iodobromide, and silver chloroiodobromide each containing silver iodide crystals in the particles thereof and showing X-ray diffraction pattern of silver iodide crystals.

The process for preparing those silver halides using silver iodobromide as exemplary. That is, silver iodobromide is prepared by first adding a silver nitrate solution to a potassium bromide solution to form silver bromide particles and then adding potassium iodide to the mixture.

Two or more kinds of silver halides in which the particle size and/or a halogen composition are different from each other may be used in admixture, if desired.

The average particle size of the silver halide used in the present invention is preferably from about 0.001 μm to about 10 μm, and more preferably from 0.001 μm to 5 μm.

The silver halide used in the present invention may be used as is, i.e., as originally formed. However, the silver halide may also be chemically sensitized with a chemical sensitizing agent such as compounds of sulfur, selenium, tellurium, etc., or compounds of gold, platinum, palladium, rhodium, iridium, etc., a reducing agent such as tin halide, etc., or a combination thereof. The details thereof are described in T. H. James, *The Theory of the Photographic Process,* 4th Ed., 1977, Chapter 5, at pages 149 to 169.

In a particularly preferred embodiment of the present invention, an organic silver salt oxidizing agent is also used. The organic silver salt oxidizing agent is a silver salt which forms a silver image upon reaction with the above-described image forming substance or a reducing agent which are copresent, if desired, with the image forming substance, when it is heated to a temperature of above about 80° C. and, preferably, above 100° C. in the presence of exposed silver halide. Due to the copresence of the organic silver salt oxidizing agent, a light-sensitive material which provides higher color density can be obtained.

The silver halide used in this case need not always have the characteristic that the silver halide contains pure silver iodide crystals in the case of using the silver halide alone. Any silver halide which is known in the art can be used.

Examples of such organic silver salt oxidizing agents include those described in European Patent Application (OPI) No. 76,492.

A silver salt of an organic compound having a carboxy group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be employed. Suitable examples of these compounds include a silver salt of benzotriazole and the derivatives thereof as described in Japanese Patent Publication Nos. 30270/69 and 18416/70, for example, a silver salt of benzotriazole, a silver salt of alkyl-substituted benzotriazole such as a silver salt of methylbenzotriazole, etc., a silver salt of a halogen-substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole or an imidazole derivative, and the like.

Moreover, a silver salt as described in *Research Disclosure,* Vol. 170, No. 17029 (June, 1978) and an organic metal salt such as copper stearate, etc., are organic metal salt oxidizing agents capable of being used in the present ivention.

Methods of preparing these silver halide and organic silver salt oxidizing agents and techniques of blending them are described in *Research Disclosure,* No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 $mg/m^2$ to 10 $g/m^2$ calculated as silver.

The light-sensitive silver halide and the organic silver salt oxidizing agent used in the present invention are prepared in the binder as described below. Further, the dye releasing redox compound used in the present invention is dispersed in the binder described below.

The binder which can be used in the present invention can be employed alone or as a combination thereof. A hydrophilic binder can be used as the binder according to the present invention. Typical hydrophilic binders are transparent or translucent hydrophilic colloids, examples of which include natural substances, for example, a protein such as gelatin, a gelatin derivative, a cellulose derivative, etc., a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of a synthetic polymer compound is a dispersed vinyl compound in a latex form which is used for the purpose of increasing the dimensional stability of the photographic material.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, can be employed in these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nuclues, a benzimidazole nucleus, a quinoline nucleus, etc., are appropriate. The carbon atoms of these nuclei may also be substituted, if desired.

Suitable merocyanine dyes and complex merocyanine dyes are those having nuclei with a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc.

These sensitizing dyes can be employed alone, and can also be employed as a combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not provide spectrally sensitizing effects but exhibit a supersentizing effect, or with materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be employed. The combinations described in U.S. Pat. Nos. 3,615,613, 3,615,641, 3,617,295 and 3,635,712 are particularly useful.

Suitable supports used in the light-sensitive material and the dye fixing material employed, if desired, according to the present invention are supports which can withstand processing temperatures. Ordinary supports such as glass, paper, metal, etc., may be used; also, an acetyl cellulose film, a cellulose ester film, a polyvinyl acetal film, a polystyrene film, a polycarbonate film, a polyethylene terephthalate film, and other films related thereto or other synthetic resin materials may be used. Further, a paper support laminated with a polymer such as polyethylene, etc., can be used. The polyesters described in U.S. Pat. Nos. 3,634,089 and 3,725,070 are preferably used.

It is advantageous to use a compound represented by formula (II) described below in the heat-developable color photographic material in order to accelerate development and accelerate release of the dye.

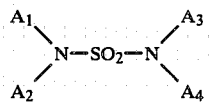

(II)

In formula (II), $A_1$, $A_2$, $A_3$ and $A_4$, which may be the same or different, each represents a hydrogen atom or a substituent selected from the group consisting of an alkyl group, a substituted alkyl group, a cycloalkyl group, an aralkyl group, an aryl group, a substituted aryl group, and a heterocyclic group; and $A_1$ and $A_2$ or $A_3$ and $A_4$ may combine with each other to form a ring.

The above-described compound of formula (II) can be used in a broad range of amounts. A useful range is up to about 20% by weight based on the weight of the dry coated layer forming the light-sensitive material. A ragne of 0.1% by weight to 15% by weight is more preferred.

It is advantageous to use a water releasing compound in the system of the present invention in order to accelerate the dye releasing reaction.

The water releasing compound means a compound which releases water upon decomposition during heat development. These compounds are particularly known in the field of printing of fabrics, and $NH_4Fe(SO_4)_2.12H_2O$, etc., as described in Japanese Patent Application (OPI) No. 88386/75 are useful.

Further, in the present invention, it is possible to use a compound which activates development while simultaneously stabilizing the image. Particularly, isothiuroniums including 2-hydroxyethylisothiuronium trichloroacetate as described in U.S. Pat. No. 3,301,678, bisisothiuroniums including 1,8-(3,6-dioxaoctane)-bis-(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc. as described in U.S. Pat. No. 4,012,260, compounds having α-sulfonylacetate as an acid moiety such as bis(2-amino-2-thiazolium)-methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496 are preferred for use.

In the present invention, it is possible to use a thermal solvent. The term "thermal solvent" means a non-hydrolyzable organic material which is solid at ambient temperature but melts together with the other components at a temperature of the heat treatment or below. Preferred examples of thermal solvents include compounds acting as a solvent for the developing agent and compounds having a high dielectric constant which accelerate physical development of silver salts. Examples of preferred thermal solvents include those described in European Patent Application (OPI) No. 76,492.

In the present invention, though it is not very necessary to further incorporate substances or dyes for preventing irradiation or halation in the light-sensitive material, because the light-sensitive material is colored by the dye releasing redox compound, it is possible to use filter dyes or light absorbing materials, etc., as described in Japanese Patent Publication No. 3692/73 and U.S. Pat. Nos. 3,253,921, 2,527,583 and 2,956,879, etc., in order to further improve the sharpness. Preferably these dyes have a thermal bleaching property. For example, the dyes as described in U.S. Pat. Nos. 3,769,019, 3,745,009 and 3,615,432 are preferred.

The light-sensitive material of the present invention may contain, if desired, various additives known for heat-developable light-sensitive materials and may include a layer other than the light-sensitive layer, for example, an antistatic layer, an electrically conductive layer, a protective layer, an intermediate layer, an antihalation layer, a strippable layer, etc.

The photographic emulsion layer and other hydrophilic colloid layers of the light-sensitive material of the present invention may contain various surface active agents for various purposes, for example, as coating aids, or for prevention of electrical charging, improvement of lubricating property, emulsification, prevention of adhesion, improvement of photographic properties (for example, acceleration of development, providing a hard tone or sensitization), etc.

For example, nonionic surface active agents such as saponin (steroid), alkylene oxide derivatives (for examples, polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamine or amides, polyethylene oxide adducts of silicone, etc.), glycidol derivatives (for example, alkenylsuccinic acid polyglycerides, alkylphenol polyglycerides, etc.), polyhydric alcohol aliphatic acid esters or saccharide alkyl esters, etc., anionic surface active agents containing acid groups such as a carboxy group, a sulfo group, a phospho group, a sulfate group, a phosphate group, etc., such as alkylcarboxylic acid salts, alkylsulfonic acid salts, alkylbenzenesulfonic acid salts, alkylnaphthalenesulfonic acid salts, alkyl sulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkylbetaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic phosphonium salts, aliphatic or heterocyclic solfonium salts, etc. can be used.

Of the above-described surface active agents, polyethylene glycol type nonionic surface active agents having ethylene oxide recurring units in their structure are preferably incorporated into the light-sensitive material. It is particularly preferred for the structure to contains 5 or more of ethylene oxide recurring units.

The nonionic surface active agents capable of satisfying the above-described conditions are well known as to their structures, properties and methods of synthesis. Such nonionic surface active agents are widely used even outside this field. Representative references describing these agents include: *Surfactant Science Series,* Vol. 1, Nonionic Surfactants (edited by Martin J. Schick, Marcel Dekker Inc., 1967), and *Surface Active Ethylene Oxide Adducts* (edited by Schoufeldt N. Pergamon Press, 1969). Suitable nonionic surface active agents described in the above-mentioned references are those capable of satisfying the above-described conditions, and such surface active agents are preferably employed in connection with the present invention.

The nonionic surface active agents can be used alone or as a mixture of two or more thereof, if desired.

Polyethylene glycol type nonionic surface active agents can be used in an amount of less than about 100% by weight, and preferably less than 50% by weight, based on the weight of hydrophilic binder present.

The light-sensitive material of the present invention may contain a cationic compound containing a pyridinium salt. Examples of cationic compounds containing a pyridinium group which can be used as described in *PSA Journal,* Section B 36 (1953), U.S. Pat. Nos. 2,648,604 and 3,671,247, Japanese Patent Publication Nos. 30074/69 and 9503/69, etc.

The photographic emulsion layer and other binder layers of the photographic light-sensitive material and the dye fixing material of the present invention may contain inorganic or organic hardeners. Chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloylhexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., can be used alone or as a combination thereof.

Examples of various additives include those described in *Research Disclosure,* Vol. 170, No. 17029 (June, 1978), for example, plasticizers, dyes for improving sharpness, antihalation dyes, sensitizing dyes, matting agents, fluorescent whitening agents and fading preventing agent, etc.

If desired, two or more layers may be coated at the same time by the method as described in U.S. Pat. No. 2,761,791 and British Pat. No. 837,095.

Various means of exposure can be used in the present invention. Latent images are obtained by imagewise exposure to radiant light including visible rays. Generally, light sources used for conventional color prints can be used in the case of the present invention; examples of such light sources include tungsten lamps, mercury lamps, halogen lamps such as iodine lamps, xenon lamps, laser light sources, CRT light sources, fluorescent tubes and light-emitting diodes, etc.

In the present invention, simultaneously with or after the heat-developable color photographic material is imagewise exposed to light, the resulting latent image can be developed by heating the entire material to a suitably elevated temperature, for example, about 80° C.

to about 250° C. for about 0.5 second to about 300 seconds. A higher temperature or lower temperature within the above-described temperature range can be utilized, with the heating time, being prolonged or shortened accordingly. Particularly, a temperature range of about 110° C. to about 160° C. is useful.

A simple heat plate, iron, heat roller, heat generator utilizing carbon or titanium white, etc., or analogues thereof may be used as the heating means.

In the present invention, the specific process for forming a color image by heat development comprises transfer of a hydrophilic mobile dye. For this purpose, the heat-developable color photographic material of the present invention comprises a support having thereon a light-sensitive layer (I) containing at least a silver halide, an organic silver salt oxidizing agent, a dye releasing redox compound which is also a reducing agent for the organic silver salt oxidizing agent and a binder, and a dye fixing layer (II) capable of receiving the hydrophilic diffusible dye formed in the light-sensitive layer (I).

The above described light-sensitive layer (I) and the dye fixing layer (II) may be formed on the same support, or they may be formed on different supports, respectively. The dye fixing layer (II) can be stripped off of the light-sensitive layer (I). For example, after the heat-developable color photographic material is exposed imagewise to light, it is developed by heating uniformly and thereafter the dye fixing layer (II) and the light-sensitive layer (I) are peeled apart. Also, when a light-sensitive material having the light-sensitive layer coated on a support and a fixing material having the dye fixing layer (II) coated on a support are separately formed, after the light-sensitive material is exposed imagewise to light and uniformly heated, the mobile dye can be transferred to the dye fixing layer (II) by superposing the fixing material on the light-sensitive material.

Further, a process can be used wherein only the light-sensitive layer (I) is exposed imagewise to light, and then heating uniformly while superposing the dye fixing layer (II) on the light-sensitive layer (I).

The dye fixing layer (II) can contain, for example, a dye mordant in order to fix the dye. In the present invention, various mordants can be used, and polymer mordants are particularly preferred. In addition to the mordants, the dye fixing layer may contain bases, base precursors and thermal solvents as previously described. In particular, incorporation of the bases or base precursors into the dye fixing layer (II) is particularly preferred where the light-sensitive layer (I) and the dye fixing layer (II) are formed on different supports.

Polymer mordants which can be used in the present invention are polymers containing secondary and tertiary amino groups, polymers containing nitrogen-containing heterocyclic moieties, polymers with quaternary cation groups thereof, having a molecular weight of from about 5,000 to about 200,000, and preferably from 10,000 to 50,000.

For example, vinylpyridine polymers and vinylpyridinium cation polymers as disclosed in U.S. Pat. Nos. 2,548,564, 2,484,430, 3,148,061 and 3,756,814, etc., polymer mordants capable of cross-linking with gelatin as disclosed in U.S. Pat. Nos. 3,625,694, 3,859,096 and 4,128,538, British Pat. No. 1,277,453, etc., aqueous sol type mordants as disclosed in U.S. Pat. Nos. 3,958,995, 2,721,852 and 2,798,063, Japanese Patent Application (OPI) Nos. 115228/79, 145529/79 and 126027/79, etc., water-insoluble mordants as disclosed in U.S. Pat. No. 3,898,088, etc., reactive mordants capable of forming covalent bonds with dyes used as disclosed in U.S. Pat. No. 4,168,976, Japanese Patent Application (OPI) No. 13733/79, etc., and mordants as disclosed in U.S. Pat. Nos. 3,709,690, 3,788,855, 3,642,482, 3,488,706, 3,557,066, 3,271,147 and 3,271,148, Japanese Patent Application (OPI) Nos. 71332/75, 30328/78, 155528/77, 125/78 and 1024/78, etc., are illustrative.

In addition, the mordants disclosed in U.S. Pat. Nos. 2,675,316 and 2,882,156 can be used.

The dye fixing layer (II) can have a white reflective layer. For example, a layer of titanium dioxide dispersed in gelatin can be provided on the mordant layer on a transparent support. The layer of titanium dioxide forms a white opaque layer, by which reflection color images of the transferred color images which is observed through the transparent support are obtained.

A typical dye fixing material used in the present invention is obtained by mixing a polymer containing ammonium salt groups with gelatin and applying the mixture to a transparent support.

The transfer of dyes from the light-sensitive layer to the dye fixing layer can be carried out using a dye transfer assistant. Examples of useful dye transfer assistants include water and an alkaline aqueous solution containing sodium hydroxide, potassium hydroxide and an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant can be employed by wetting the image receiving layer with the transfer assistant or by incorporating it in the form of water of crystallization or microcapsules into the material.

The present invention will be described in greater detail with reference to the following examples. However, the present inention is not to be construed as being limited to these examples.

In the examples, dye-releasing redox compounds described in European Patent Application (OPI) No. 76,492 were used.

Dye-Releasing Redox Compounds (1)

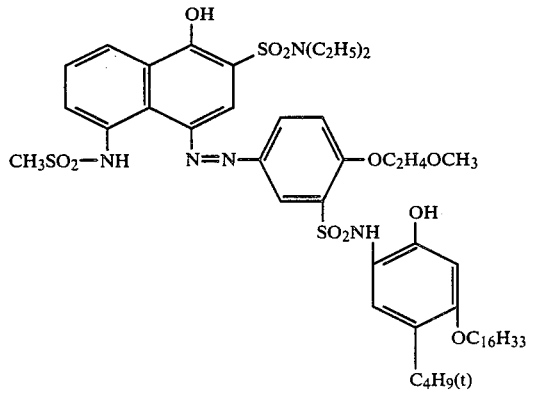

Dye-Releasing Redox Compound (2)

-continued

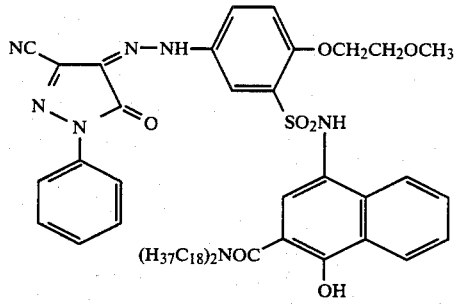

Dye-Releasing Redox Compound (3)

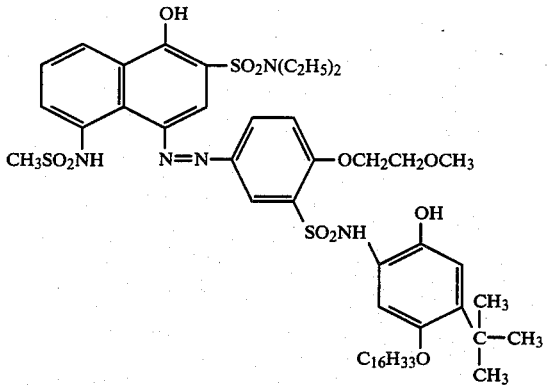

Dye-Releasing Redox Compound (4)

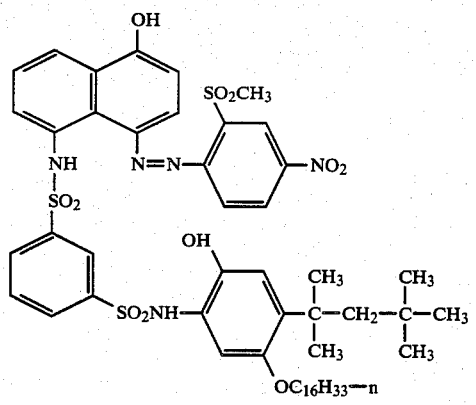

EXAMPLE 1

Preparation of Iodobromide Emulsion

A mixture of 40 g of gelatin and 26 g of potassium bromide (KBr) was dissolved in 3,000 ml of water. This solution was stirred while maintaining it at 50° C. Then a solution of 34 g of silver nitrate in 200 ml of water was added to the solution over 10 minutes.

A solution of 3.3 g of potassium iodide (KI) in 100 ml of water was then added thereto over 2 minutes.

The thus-prepared silver iodobromide emulsion was precipitated by adjusting the pH to remove excess salts.

The emulsion was then adjusted to pH 6.0. In this way, 400 g of a silver iodobromide emulsion was obtained.

Preparation of Gelatin Dispersion of Dye-Releasing Redox Compound Containing a Compound of the General Formula (A)

To 5 g of Dye-Releasing Redox Compound (1), 0.5 g of sodium 2-ethylhexyl succinate sulfonate, and 5 g of Compound (48) of formula (A) was added 30 ml of ethyl acetate. The mixture was then heated at about 60° C. to prepare a homogeneous solution. This solution was mixed with 100 g of a 10% solution of lime-treated gelatin and dispersed therein by the use of a homogenizer for 10 minutes at 10,000 rpm. This dispersion is called a "dispersion of a dye-releasing redox compound containing a compound of formula (A)".

Preparation of a Light-Sensitive Coated Material

| | | |
|---|---|---|
| (a) | Light-sensitive Silver Iodobromide Emulsion | 25 g |
| (b) | Dispersion of Dye-Releasing Redox Compound Containing a Compound of Formula (A) | 33 g |
| (c) | 10% Ethanol Solution of Guanidine-trichloroacetic Acid | 15 ml |
| (d) | 5 wt % Aqueous Solution of the following Compound: | 5 ml |
| | 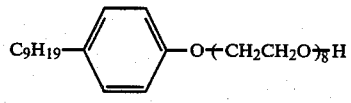 | |
| (e) | 10 wt % Aqueous Solution of Dimethyl Sulfamide | 4 ml |
| (f) | Water | 5 ml |

The above ingredients (a) to (f) were mixed, dissolved by heating, and coated on a polyethylene terephthalate film in a wet coating thickness of 30 μm. A 3% by weight aqueous solution of gelatin was further coated thereon in a wet coating thickness of 30 μm to provide a protective layer. The thus-prepared coated material is designated as "Sample (A)".

For comparison, light-sensitive coated materials were prepared in the same manner as above except that Comparative Compounds (1) and (2) as described below were used in place of Compound (48) of formula (A). These light-sensitive coated materials are designated as "Sample (B)" and "Sample (B')" respectively.

Comparative Compound (1)

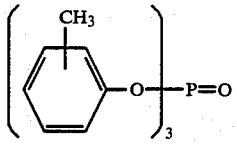

Comparative Compound (2)

$C_{11}H_{23}CON(C_2H_5)_2$

After drying, each sample was exposed imagewise at 2,000 lux for 10 seconds by the use of a tungsten lamp and then uniformly heated for 30 seconds on a heat block maintained at 130° C.

Preparation of Image-Receiving Material

Poly(methyl acrylate-co-N,N,N-trimethyl-N-vinylbenzylammonium chloride)

(i,e., a 1:1 (by mole) copolymer of methyl acrylate and N,N,N-trimethyl-N-vinylbenzylammonium chloride) (10 g) was dissolved in 200 ml of water and uniformly mixed with 100 g of 10% lime-treated gelatin. This mixture was uniformly coated on a polyethylene-laminated paper support in a wet coating thickness of 90 μm. The polyethylene contained titanium dioxide dispersed therein. This material was dried and then used as an image-receiving material having a mordanting layer.

The image-receiving material was dipped in water and then the light-sensitive material heated immediately after coating was superposed on the image-receiving material in such a manner that the coated layers were in contact with each other. They were then heated for 6 seconds on a heat block maintained at 80° C., and the image-receiving material was stripped from the light-sensitive material, whereupon a negative magenta image was obtained on the image-receiving material. This negative image was measured for the maximum density (Dmax) relative to green light and the fog density (Dmin) by the use of a Macbeth reflection densitometer (RD-519).

Samples (A), (B) and (B') were also stored at room temperature for 3 months in such a condition that the samples were shielded against light, and then exposed imagewise, heated, and processed to transfer a dye to the image-receiving material under the same conditions as described above. The thus-obtained negative image was measured for the density to green light using a Macbeth reflection densitometer (RD-519). The results are shown in Table 1.

TABLE 1

| Sample | Just after Preparation | | After Storage for 3 Months | |
|---|---|---|---|---|
| | Dmax | Dmin | Dmax | Dmin |
| (A) (Present Invention) | 1.77 | 0.28 | 1.85 | 0.41 |
| (B) (Comparative Example) | 1.83 | 0.35 | 2.33 | 1.92 |
| (C) (Comparative Example) | 2.02 | 0.53 | 2.38 | 2.24 |

It can be seen from Table 1 that the compound of formula (A) substantially prevents the formation of fog and change in maximum density, and improves stability over an extended period of time.

EXAMPLE 2

In this example, silver benzotriazole, an organic silver salt oxidizing agent, was used.

Preparation of Silver Benzotriazole Emulsion

A mixture of 28 g of gelatin and 13.2 g of benzotriazole was dissolved in 3,000 ml of water. This solution was stirred while maintaining it at 40° C. A solution of 17 g of silver nitrate in 100 ml of water was added thereto over 2 minutes.

The thus-prepared silver benzotriazole emulsion was adjusted for pH, precipitated, and excess salts were removed therefrom. Then, the emulsion was adjusted to pH 6.0. In this way, 400 g of a silver benzotriazole emulsion was obtained.

Using the silver benzotriazole emulsion, a light-sensitive coated material as described below was prepared.

| | | |
|---|---|---|
| (a) | Silver Iodobromide Emulsion of Example 1 | 20 g |
| (b) | Silver Benzotriazole Emulsion | 10 g |
| (c) | Dispersion (prepared in the same manner as in Example 1 except that Compound (48) was replaced by each of the compounds shown in Table 2) | 33 g |
| (d) | 10% Ethanol Solution of Guanidine-trichloroacetic Acid | 16 ml |
| (e) | 5 wt % aqueous Solution of the Following Compound: 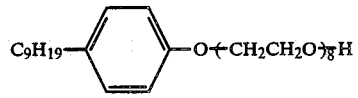 | |
| (f) | 10 wt % Aqueous Solution of Dimethylsulfamide | 4 ml |
| (g) | Water | 5 ml |

The above ingredients (a) to (g) were mixed, dissolved by heating, and coated on a polyethylene terephthalate film in a wet coating thickness of 30 μm. A 3% aqueous solution of gelatin was coated thereon in a wet coating thickness of 30 μm to provide a protective layer.

In this way, Samples (C) to (H) were prepared. Sample (I) was prepared using Comparative Compound (1) above in place of a compound of formula (A).

TABLE 2

| Sample | Compound Used in Dispersion | Dye-Releasing Redox Compound |
|---|---|---|
| (C) | Compound (26) | (1) |
| (D) | Compound (27) | (1) |
| (E) | Compound (41) | (1) |
| (F) | Compound (12) | (1) |
| (G) | Compound (14) | (1) |
| (H) | Compound (20) | (1) |
| (I) | Comparative Compound (1) | (1) |

Samples (C) to (I) were each measured for the reflection density to green light just after the preparation and also after storage for 2 days in a thermostatic container at 50° C. in the same manner as in Example 1. The results are shown in Table 3 below.

TABLE 3

| Sample | Just after Preparation | | After Storage at 50° C. for 2 Days | |
|---|---|---|---|---|
| | Dmax | Dmin | Dmax | Dmin |
| (C) | 1.92 | 0.22 | 2.03 | 0.33 |
| (D) | 1.89 | 0.20 | 2.15 | 1.21 |
| (E) | 1.85 | 0.27 | 2.24 | 1.06 |
| (F) | 2.00 | 0.25 | 2.23 | 0.61 |
| (G) | 1.81 | 0.19 | 2.02 | 0.35 |
| (H) | 1.98 | 0.29 | 2.34 | 0.82 |
| (I) | 2.16 | 0.32 | 2.34 | 1.83 |

It can be seen from Table 3 that the compounds of formula (A) substantially prevent the formation of fog during storage and improve stability with time.

EXAMPLE 3

Using dispersions of the compounds of the present invention as indicated in Table 4, light-sensitive coated materials samples (J) to (O) were prepared under the same conditions as in Example 2 (Sample (G)). Samples (K), (M) and (O) were prepared using Comparative Compound (1) in place of the compound of formula (A).

TABLE 4

| Sample | Compound Used in Dispersion | Dye-Releasing Redox Compound | Hue |
|---|---|---|---|
| (J) | Compound (14) | (2) | Yellow |
| (K) | Comparative Compound (1) | (2) | " |
| (L) | Compound (14) | (3) | Magenta |
| (M) | Comparative Compound (1) | (3) | " |
| (N) | Compound (14) | (4) | Cyan |
| (O) | Comparative Compound (1) | (4) | " |

Samples (J) to (O) were each measured for the reflection density to blue light (Samples (J) and (K)), green light (Samples (L) and (M) and red light (Samples (N) and (O)) just after the preparation thereof and also after storage for 2 days in a thermostatic container at 50° C. in a light-shielded condition, under the same conditions as in Example 1. The results are shown in Table 5 below.

TABLE 5

| Sample | Just after Preparation | | After Storage at 50° C. for 2 Days | |
|---|---|---|---|---|
| | Dmax | Dmin | Dmax | Dmin |
| (J) | 1.83 | 0.25 | 1.90 | 0.30 |
| (K) | 2.10 | 0.27 | 2.16 | 0.82 |
| (L) | 2.02 | 0.18 | 2.15 | 0.27 |
| (M) | 2.29 | 0.19 | 2.34 | 1.96 |
| (N) | 1.92 | 0.20 | 2.02 | 0.27 |
| (O) | 2.03 | 0.22 | 2.16 | 0.91 |

It can be seen from Table 5 that when used in conjunction with Dye-Releasing Redox Compounds (2), (3) and (4), the use of the compounds of formula (A) substantially prevents the formation of fog and improves stability with time.

EXAMPLE 4

Samples (P), (Q), (R) and (S) were prepared in the same manner as in Example 2 except that the compounds of the present invention and the dye-releasing redox compounds were replaced by the compounds of formula (A) and the dye-releasing redox compound shown in Table 6 below.

TABLE 6

| Sample | Compound of General Formula (A) | Dye-Releasing Redox Compounds |
|---|---|---|
| (P) | (21) | (1) |
| (Q) | (23) | (1) |
| (R) | (25) | (1) |
| (S) | (48) | (1) |

Samples (P) to (S) were each examined for the formation of fog just after the preparation and also after storage for 2 days in a thermostatic container at 50° C. In all cases, the formation of fog with the lapse of time was substantially prevented.

While the invention has been described in detail and with reference to specific embodiments thereof, it will be apparent to one skilled in the art that various changes and modifications can be made therein without departing from the spirit and scope thereof.

What is claimed is:

1. A heat developable color photographic material comprising:

a support bearing thereon light-sensitive silver halide;

a binder;

a dye-releasing redox compound capable of reducing the silver halide and releasing a hydrophilic dye on reaction with the silver halide when heated in a substantially water-free condition; and a compound having a melting point below 60° C. represented by formula (A)

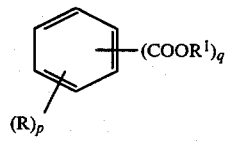

(A)

wherein p is an integer of 1 to 5 and q is an integer of 1 to 4, provided that p+q is 6 or less; R represents a hydrogen atom, an alkyl group, a cycloalkyl group, an alkenyl group, an aryl group, an alkoxy group, an aryloxy group, an aralkyl group, an acyl group, an acylamino group, an alkylsulfonylamino group, an arylsulfonylamino group, an alkoxyalkyl group, an aryloxyalkyl group, an acyloxy group, an acyloxyalkyl group, a carbamoyl group, an N-substituted carbamoyl group, a ureido group, an N-substituted ureido group, an alkylamino group, a dialkylamino group, an arylamino group, a halogen atom, a hydroxy group, a carboxy group, a nitro group, a cyano group, an alkoxycarbonyl group, an aryloxycarbonyl group or a cycloalkyloxycarbonyl group; and $R^1$ represents an alkyl group, an alkenyl group, a cycloalkyl group or an aryl group, thereby to improve stability with time during storage prior to heat development.

2. The material as claimed in claim 1, wherein said alkyl, cycloalkyl or aryl group represented by R, or the alkyl, cycloalkyl or aryl moieties of said groups represented by R is substituted with a halogen atom, a hydroxy group, an alkoxy group, a cyano group, an aryloxy group, an alkyl group, an alkoxycarbonyl group or an aryloxycarbonyl group.

3. The material as claimed in claim 1, wherein R represents an alkyl group, an alkoxy group, a halogen atom, or a hydrogen atom.

4. The material as claimed in claim 3, wherein R represents a hydrogen atom.

5. The material as claimed in claim 1, wherein said alkyl, cycloalkyl, alkenyl, aryl, alkoxy, aryloxy, aralkyl, acyl, acylamino, alkylsulfonylamino, arylsulfonylamino, alkoxyalkyl, aryloxyalkyl, acyloxy, acyloxyalkyl, carbamoyl, N-substituted carbamoyl, ureido, N-substituted ureido, alkylamino, dialkylamino, arylamino, alkoxycarbonyl, aryloxycarbonyl or cycloalkyloxycarbonyl group represented by R has up to 40 carbon atoms in total.

6. The material as claimed in claim 5, wherein said alkyl, cycloalkyl, alkenyl, aryl, alkoxy, aryloxy, aralkyl, acyl, acylamino, alkylsulfonylamino, arylsulfonylamino, alkoxyalkyl, aryloxyalkyl, acyloxy, acyloxyalkyl, carbamoyl, N-substituted carbamoyl, ureido, N-substituted ureido, alkylamino, dialkylamino, arylamino, alkoxycarbonyl, aryloxycarbonyl or cycloalkyloxycarbonyl group represented by R has up to 20 carbon atoms in total.

7. The material as claimed in claim 2, wherein said alkyl, cycloalkyl, alkenyl, aryl, alkoxy, aryloxy, aralkyl, acyl, acylamino, alkylsulfonylamino, arylsulfonylamino, alkoxyalkyl, aryloxyalkyl, acyloxy, acyloxyalkyl, carbamoyl, N-substituted carbamoyl, ureido, N-substituted ureido, alkylamino, dialkylamino, arylamino, alkoxycarbonyl, aryloxycarbonyl or cycloalkyloxycarbonyl group represented by R has up to 40 carbon atoms in total.

8. The material as claimed in claim 7, wherein said alkyl, cycloalkyl, alkenyl, aryl, alkoxy, aryloxy, aralkyl, acyl, acylamino, alkylsulfonylamino, arylsulfonylamino, alkoxyalkyl, aryloxyalkyl, acyloxy, acyloxyalkyl, carbamoyl, N-substituted carbamoyl, ureido, N-substituted ureido, alkylamino, dialkylamino, arylamino, alkoxycarbonyl, aryloxycarbonyl or cycloalkyloxycarbonyl group represented by R has up to 20 carbon atoms in total.

9. The material as claimed in claim 1, wherein said alkyl, alkenyl cycloalkyl or aryl group represented by $R^1$ is substituted with a halogen atom, a hydroxy group, an alkoxy group, a cyano group, an aryloxy group, an alkyl group or an alkoxycarbonyl group.

10. The material as claimed in claim 1, wherein said alkyl, alkenyl, cycloalkyl or aryl group represented by $R^1$ has up to 60 carbon atoms in total.

11. The material as claimed in claim 9, wherein said alkyl, alkenyl, cycloalkyl or aryl group represented by $R^1$ has up to 60 carbon atoms in total.

12. The material as claimed in claim 11, wherein $R^1$ represents an alkyl group having from 1 to 40 carbon atoms, a cycloalkyl-alkyl group having from 6 to 46 carbon atoms, an alkenyl group having from 2 to 40 carbon atoms, or an alkoxycarbonylalkyl group having from 3 to 60 carbon atoms.

13. The material as claimed in claim 12, wherein $R^1$ represents an alkyl group having from 1 to 20 carbon atoms, a cycloalkylalkyl group having from 6 to 26 carbon atoms, an alkenyl group having from 2 to 20 carbon atoms, or an alkoxycarbonylalkyl group having from 3 to 40 carbon atoms.

14. The material as claimed in claim 12, wherein $R^1$ represents an alkyl group.

15. The material as claimed in claim 13, wherein $R^1$ represents an alkyl group.

16. The material as claimed in claim 1, wherein the compound of formula (A) p is 4 and q is 2, or p is 5 and q is 1.

17. The material as claimed in claim 16, wherein R represents a hydrogen atom.

18. The material as claimed in claim 1, wherein the compound of formula (A) is contained as a dispersion in a hydrophilic colloid.

19. The material as claimed in claim 18, wherein the compound of formula (A) is contained as a dispersion in a hydrophilic colloid in combination with the dye-releasing redox compound.

20. The material as claimed in claim 1, wherein the compound of formula (A) is contained in an amount of from 0.001 to 5 g/m$^2$.

21. The material as claimed in claim 18, wherein the compound of formula (A) is contained in an amount of from 0.001 to 5 g/m$^2$.

22. The material as claimed in claim 19, wherein the compound of formula (A) is contained in an amount of from 0.01 to 20 times by weight, the amount of dye-releasing redox compound.

23. The material as claimed in claim 19, wherein the compound of formula (A) is contained in an amount of from 0.01 to 5 times by weight, the amount of dye-releasing redox compound.

24. The material as claimed in claim 1, wherein said dye-releasing material is a dye-releasing redox compound releasing a hydrophilic diffusible dye and having the formula $$R_a—SO_2—D \qquad (I)$$

wherein $R_a$ represents a reducing group capable of being oxidized by silver halide and D represents an image forming dye moiety containing a hydrophilic group.

25. The material as claimed in claim 24, wherein said light-sensitive material additionally contains an auxiliary developing agent which is oxidized by said silver halide forming an oxidized product having the ability to oxidize reducing group $R_a$ in said dye-releasing redox compound of the general formula (I).

26. The material as claimed in claim 1, wherein said light-sensitive material additionally contains a reducing agent.

27. The material as claimed in claim 1, wherein said light-sensitive material additionally contains an organic silver salt oxidizing agent.

28. The material as claimed in claim 1, wherein said light-sensitive material additionally contains a compound accelerating development and release of dye and represented by the following general formula:

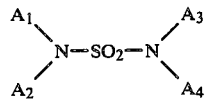

wherein $A_1$, $A_2$, $A_3$ and $A_4$, each is a hydrogen atom, an alkyl group, a substituted alkyl group, a cycloalkyl group, an aralkyl group, an aryl group, a substituted aryl group or a heterocyclic group; and $A_1$ and $A_2$ or $A_3$ and $A_4$ may combine and form a ring.

29. The material as claimed in claim 25, wherein said light-sensitive material comprises a light-sensitive layer (I) containing at least a silver halide, an organic silver salt oxidizing agent, a dye-releasing redox compound of the formula (I), and a binder; and a dye-fixing layer (II) capable of receiving the hydrophilic diffusible dye formed in light-sensitive layer (I).

30. A process for forming an image comprising heating a light-sensitive material in a substantially water-free condition to form a mobile dye in an image pattern, said material having a support bearing thereon light-sensitive silver halide, a binder and a dye-releasing redox compound capable of imagewise reducing the silver halide and releasing a hydrophilic dye on reaction with said silver halide when heated, after or simultaneously with imagewise exposure, in the presence of a compound having a melting point below 60° C. represented by formula (A)

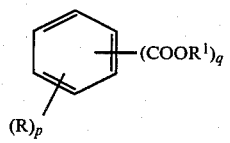

(A)

wherein p is an integer of 1 to 5 and q is an integer of 1 to 4, provided that p+q is 6 or less; R represents a hydrogen atom, an alkyl group, a cycloalkyl group, an alkenyl group, an aryl group, an alkoxy group, an aryloxy group, an aralkyl group, an acyl group, an acylamino group, an alkylsulfonylamino group, an arylsulfonylamino group, an alkoxyalkyl group, an aryloxyalkyl group, an acyloxy group, an acyloxyalkyl group, a carbamoyl group, an N-substituted carbamoyl group, a ureido group, an N-substituted ureido group, an alkylamino group, a dialkylamino group, an arylamino group, a halogen atom, a hydroxy group, a carboxy group, a nitro group, a cyano group, an alkoxycarbonyl group, an aryloxycarbonyl group, or a cycloalkyloxycarbonyl group; and $R^1$ represents an alkyl group, an alkenyl group, a cycloalkyl group or an aryl group.

31. The process as claimed in claim 30, wherein said dye-releasing material is a dye-releasing redox compound releasing a hydrophilic diffusible dye and having the formula $$R_a—SO_2—D \quad (I)$$

wherein $R_a$ represents a reducing group capable of being oxidized by silver halide and D represents an image forming dye moiety containing a hydrophilic group.

32. The process as claimed in claim 31, wherein said light-sensitive material additionally contains an auxiliary developing agent which is oxidized by silver halide forming an oxidized product having the ability to oxidize reducing group $R_a$ in said dye-releasing redox compound of the general formula (I).

33. The process as claimed in claim 30, wherein said light-sensitive material additionally contains a reducing agent.

34. The process as claimed in claim 30, wherein said light-sensitive material additionally contains an organic silver salt oxidizing agent.

35. The process as claimed in claim 30, wherein said light-sensitive material additionally contains a compound accelerating development and release of dye and represented by the following general formula

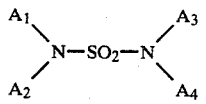

wherein $A_1$, $A_2$, $A_3$ and $A_4$, each is a hydrogen atom, an alkyl group, a substituted alkyl group, a cycloalkyl group, an aralkyl group, an aryl group, a substituted aryl group or a heterocyclic group; and $A_1$ and $A_2$ or $A_3$ and $A_4$ may combine and form a ring.

36. The process as claimed in claim 31, wherein said light-sensitive material comprises a light-sensitive layer (I) containing at least a silver halide, an organic silver salt oxidizing agent, a dye-releasing redox compound of the formula (I), and a binder; and a dye-fixing layer (II) capable of receiving the hydrophilic diffusible dye formed in light-sensitive layer (I).

* * * * *